US007275958B2

(12) United States Patent
Unruh

(10) Patent No.: US 7,275,958 B2
(45) Date of Patent: Oct. 2, 2007

(54) SEALING ARRANGEMENT OF A PIEZOACTUATOR IN A FUEL INJECTOR

(75) Inventor: Marcus Unruh, Zeitlarn (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/458,583

(22) Filed: Jul. 19, 2006

(65) Prior Publication Data

US 2007/0033892 A1 Feb. 15, 2007

(30) Foreign Application Priority Data

Jul. 25, 2005 (DE) ..... 10 2005 034 689

(51) Int. Cl.
*H01R 13/40* (2006.01)

(52) U.S. Cl. ..... 439/587; 239/102.2

(58) Field of Classification Search ..... 439/587, 439/322; 239/102.2, 88

See application file for complete search history.

(56) References Cited

U.S. PATENT DOCUMENTS 7,175,105 B2 * 2/2007 Plecher et al. ..... 239/102.2
2006/0038031 A1 * 2/2006 Unruh ..... 239/102.2
2006/0038032 A1 * 2/2006 Plecher et al. ..... 239/102.2

FOREIGN PATENT DOCUMENTS

| | | |
|---|---|---|
| DE | 19956256 | 11/1999 |
| DE | 10007175 | 8/2001 |
| DE | 10251225 | 5/2004 |

* cited by examiner

*Primary Examiner*—Tho D. Ta
(74) *Attorney, Agent, or Firm*—Baker Botts L.L.P.

(57) ABSTRACT

A seal for a piezoactuator in a fuel injector as simply, reliably and, in respect of the useful life of the piezoactuator, as favorably as possible has a support element (28), positioned on terminal posts (20) projecting in an axial direction (A) out of the piezoactuator (12) and pressed in an axial direction toward a top arrangement (14, 18) of the piezoactuator (20). An external sealing ring (36) is clamped along a circumferential region (14) of the top arrangement between the support element (28) and the top arrangement. Internal sealing rings (38) each enclose one of the terminal posts (20) and are each clamped between a face of the support element (28) facing radially inward and a circumferential face of the terminal post (20).

20 Claims, 4 Drawing Sheets

SEALING ARRANGEMENT OF A PIEZOACTUATOR IN A FUEL INJECTOR

PRIORITY

This application claims priority from German Patent Application No. DE 10 2005 034 689.8, which was filed on Jul. 25, 2005, and is incorporated herein by reference in its entirety.

TECHNICAL FIELD

The present invention relates to a sealing arrangement for a piezoactuator in a fuel injector.

BACKGROUND

Such an arrangement is known for example from DE 102 51 225 A1. With this prior art, to create a durable, in particular oil-tight, seal between a piezoactuator and an external contact arrangement, it is proposed that a fuel-resistant sealing ring (O ring) be inserted into each opening of a top plate positioned thereon. A collar made of an insulating material is also inserted below the sealing ring in each through opening, said collar ensuring the centering and electrical insulation of the terminal post.

It is a disadvantage of this known piezoactuator contact arrangement that it requires a comparatively thick top plate, in order to accommodate a sealing ring and a centering collar respectively in its through openings.

Also with this prior art a number of individual sealing components have to be used during assembly of the injector, thereby making it a comparatively complex operation.

The piezoactuator sealed with the known arrangement also has a limited useful life. It has proven that this useful life is a function of the installation environment of the fuel injector.

SUMMARY

The object of the present invention is to develop a sealing arrangement of the type mentioned in the introduction, such that a simple and reliable seal can be achieved, in particular for comparatively thin top plates.

This object can be achieved by a sealing arrangement to seal a piezoactuator in a fuel injector in an internal combustion engine comprising terminal posts projecting in an axial direction from the piezoactuator and a top arrangement positioned on the piezoactuator, provided with openings for the passage of the terminal posts, a support element, provided with openings for the passage of the terminal posts, positioned on the terminal posts and pressed in an axial direction toward the top arrangement, an external sealing ring, which is clamped along a circumferential region of the top arrangement between the support element and the top arrangement, and internal sealing rings, each enclosing one of the terminal posts and each being clamped between a face of the support element facing radially inward and a circumferential face of the terminal post.

The support element can be formed of plastic. The material of the support element can be significantly more rigid than the material of the external sealing ring and the material of the internal sealing rings. The support element can be essentially disk-shaped, but having cup-shaped regions to receive the internal sealing rings. The external sealing ring can be clamped between end face regions of the support element extending essentially orthogonally and the top arrangement. The support element can be pressed by a contact module positioned thereon to connect the terminal posts further in an electrical manner to an external electrical terminal of the fuel injector. The material of the external sealing ring and/or the internal sealing rings can be an elastomer. A disk made of electrically insulating material and provided with openings for the passage of the terminal posts can be arranged on the face of the top arrangement facing the support element. The support element, together with the external sealing ring and/or the internal sealing rings, can be provided as a pre-manufactured sealing unit. A fluid-tight but gas-permeable gas exchange element can be arranged on the support element to promote the gas permeability of the sealing arrangement.

The inventive sealing arrangement is characterized by:

- a support element, which is provided with openings for the passage of the terminal posts, is positioned on the terminal posts and is pressed in an axial direction toward the top arrangement,
- an external sealing ring, which is clamped along a circumferential region of the top arrangement between the support element and the top arrangement, and
- internal sealing rings, each enclosing one of the terminal posts and each being clamped between a face of the support element facing radially inward and a circumferential face of the terminal post.

The support element provided with the invention is sealed by means of the external sealing ring toward the circumferential region of the top arrangement and by means of internal sealing rings toward the terminal posts, with a reliable seal being facilitated by the clamping of said sealing rings. These sealing components lie outside the space bounded by the through openings of the top arrangement, such that there is greater structural flexibility irrespective of this bounded space of the through openings and said sealing arrangement is particularly suitable, even for top arrangements having a comparatively thin top plate.

The greater structural flexibility that results from the seal being outside the bounded space of the through openings can also be used according to the invention to create a gas permeability of the sealing arrangement that is advantageous in respect of the useful life or durability of the piezoactuator, as described in more detail below.

A preferred use of the inventive sealing arrangement results for the piezoactuator of a fuel injector of an internal combustion engine, wherein the fuel injector and at least one further component of a fuel injection unit are arranged essentially completely within an engine block module of the internal combustion engine. This relates in particular to the instance where components of the injection unit are housed within the engine block module, which could also be housed outside it without restricting their function. The term "engine block module" here refers to all the components containing engine lubricating oil, i.e. the engine block in the narrower sense and attached components (e.g. a cylinder head cover) wherein the lubricating oil is pumped or spread or ducted (back). With such an engine structure there is a greater risk of damaging media such as oil and/or fuel entering the interior of an injector housing. This problem arises in particular with common-rail diesel engines with injection components located within the cylinder head cover.

In one embodiment of the invention, the support element is made of plastic, for example in the form of an injection-molded part.

The material of the support element is preferably significantly more rigid than the material of the external sealing ring and the material of the internal sealing rings. This has the advantage in particular that the support element, which is pressed in the direction of the top arrangement, is then able to define the position of the clamped sealing rings particularly clearly. Also in this instance it is possible, by suitably configuring the form of the support element and in particular the support element sections in contact with the sealing rings, to achieve a clearly defined clamping effect, with which the compressive forces acting on the support element are induced to a certain degree specifically to apply pressure to the sealing ring material. An effective sealing action, which at the same time preserves the sealing material, can thereby be achieved. This applies equally to the external sealing ring and the internal sealing rings.

Irrespective of the specific embodiment of the invention, one advantage of the invention is that both the external sealing ring and the internal sealing rings are subject to a load from a clamping force component acting orthogonally in respect of the sealing faces. This results in a "pressure bracing" of the sealing ring material, which in practice prevents any fissure formation for example in the sealing ring material, from the outset.

As far as a reliable and efficient radial exertion of pressure on the internal sealing rings is concerned, one embodiment for example is advantageous, wherein the support element has cup-shaped regions to receive the internal sealing rings. These sealing rings can then be pressed by the respective cup walls radially against the enclosed terminal posts. Such cup-shaped regions can for example be created as indentations in an essentially disk-shaped support element. To achieve radial clamping of the internal sealing rings with these, provision can for example be made for the internal diameter of the space defined by the cup-shaped regions to be smaller than the external diameter of the internal sealing rings received therein in their relaxed state. Another possibility for producing radial clamping is to have the internal walls of the cup-shaped regions running at a certain angle to the axial direction (e.g. conically), to convert the compressive force acting on the support element in an axial direction in the interior of the cup-shaped regions to a "clamping force with radial component" for the internal sealing rings. As an alternative or in addition to one or both of the possibilities described above for creating radial clamping, it is possible to cause the compressive force acting on the support element in an axial direction to act so significantly on the material of the sealing ring through the material of the support element, that axial pressure bracing results in the sealing ring material, producing pressure bracing that also comprises radial components in the sealing ring material as a whole. This can be achieved in a simple manner for example by using a sealing ring dimensioned such that in its relaxed state it fits more or less exactly in the cup-shaped space bounded by the support element, the terminal post and the top arrangement and the material of the support element has a certain flexibility, such that its axial compression of necessity exerts a pressure on the sealing ring.

Also for the spatial definition of the external sealing ring, the support element and/or the corresponding top arrangement region can have a recess to receive part of said sealing ring (e.g. an annular groove). The axial clamping provided for the external sealing ring can however quite generally be achieved in a very simple manner by clamping said sealing ring between end face regions of the support element and the top arrangement that extend essentially orthogonally in respect of the axial direction.

There are various possibilities for pressing the support element. It can be done for example by means of a molding process, wherein molding material is applied in an axial direction to the support element and then becomes rigid.

In one preferred embodiment, the support element is pressed by a contact module positioned thereon to connect the terminal posts further in an electrical manner to an external electrical terminal of the fuel injector. Such a contact module can for example be formed by a plastic molding with metal contacts that are formed onto it and are to be welded to the terminal posts of the piezoactuator. Such a contact module is known per se and is described for example in DE 198 44 743 C1.

The support elements are pressed axially in a clearly defined manner, if the contact module is provided for this purpose with one or more projections facing the support element, which result during assembly of the fuel injector in the induction of axial compressive forces at the support element sections in contact with the projections. Alternatively a face of the contact module facing the support element can essential follow the contour of the support element and thus lie with essentially its entire surface against the support element to exert a compressive force that is distributed evenly over the cross section of the support element.

Simple assembly of the contact module, wherein the compression of the support element described above can be ensured, results if the contact module encloses a circumferential region of the top arrangement and is held on this circumferential region by a positive connection. This positive connection can in particular be provided as a latching connection such that the contact module is simply pressed down to latch with the top arrangement. The latching connection can for example run in an annular manner at the circumference or can comprise a number of latching regions distributed over the circumference.

In one preferred embodiment the material of the external sealing ring and/or the internal sealing rings is an elastomer, more preferably an electrically insulating elastomer. If an electrically insulating material is selected, no special precautions have to be taken against inadequate electrical insulation of the terminal posts in the instance where the top arrangement and/or the material of the support element is/are electrically conductive. This is generally the case, as the top arrangement is generally made of metallic materials.

In particular in the instance where the top arrangement is electrically conductive and the material of the internal sealing rings and/or the material of the support element does not have adequate electrical insulation, the top arrangement can be electrically insulated, e.g. provided with an insulating layer or insulating element, at least in the regions where the support element is in contact with the top arrangement. This insulating layer can for example be configured as a disk with openings for the passage of the terminal posts, made of an electrically insulating material and extending almost to the circumferential region of the top arrangement.

Such an insulating disk can advantageously be provided with collar extensions (e.g. formed on as a single part), which extend into the through openings of the top arrangement, to insulate the terminal posts there from the internal walls of said openings.

In one development, the above-mentioned collar extensions of an insulating disk can carry out a further function, if they also continue to some extent in an axial direction on the side of the insulating disk opposite the top arrangement and then serve respectively as defined bearing surfaces for one of the internal sealing rings.

In one development of the invention, the support element is provided together with the external sealing ring and/or the internal sealing rings as a pre-manufactured sealing unit. In practice this can significantly facilitate the creation of the seal when assembling the fuel injector.

For simple production the external sealing ring and/or the internal sealing ring can for example be configured as a molding around a support element body. In particular the sealing material arranged on such a support element body can be supplied wholly or partially as a component in a two-component injection molding method.

In a different embodiment of the pre-manufactured sealing unit, an internal connection is created by vulcanization between a support element body and the sealing material.

Finally, to produce a pre-manufactured sealing unit, a positive connection is also provided between a support element body and sealing ring materials.

In-house tests by the applicant have surprisingly shown that the arrangement of a piezoceramic component, such as the piezoactuator of interest here, in the "most gas-tight possible" piezohousing arrangement in an installation environment having damaging media in practice does not extend the useful life of the component but tends rather to shorten it.

In contrast a certain "gas permeability" in the region of the sealing arrangement can significantly extend the durability or useful life of the piezoactuator. One possible explanation for this is that when the piezohousing is as gas-tight as possible, in certain operating conditions a partial vacuum results inside the housing (e.g. due to temperature fluctuations) as a result of which damaging media can penetrate into the interior of the housing through the seal, which in practice cannot be configured in a totally hermetic manner. Other possible explanations are for example that after the manufacture of a hermetically sealed piezodrive, the concentration of life-shortening gas inside the piezodrive increases or that if the content of the interior of the housing resembles the air in the atmosphere, this has a positive effect on the useful life of the piezoelectric ceramic.

In the case of the inventive sealing arrangement, as mentioned in the introduction, the seal is outside the space bounded by the through openings of the top arrangement. In the case of the invention the sealing site is therefore "displaced outward", advantageously increasing the sealed actuator chamber. Also in the case of the invention there is therefore already in principle a tendency towards increased gas permeability of the sealing arrangement, as the sealing ring material has greater spatial expansion (in particular due to the arrangement of the internal sealing ring) and thus a defined gas permeability for the sealing ring material or support element material used results in a higher gas exchange rate. With the predetermined gas permeability of the materials to be penetrated, the gas exchange rate is proportional to the sealing surface defined by these materials. In the case of the invention however this sealing surface extends over a comparatively large space (not bounded by the through openings of the top arrangement). The inventive sealing concept therefore has an inherently improved gas permeability, which in turn advantageously extends the useful life or durability of the piezoactuator.

In one development of the invention the in principle already improved gas permeability of the sealing arrangement is further enhanced. There are quite a few possibilities for this, as described below.

In one embodiment the material of the external sealing ring and/or the internal sealing rings has a high gas permeability. A silicon material, in particular a fluoric silicon material, can in particular be selected as said material (for example elastomers of the "LSR" or "FVMQ" type). Said latter materials facilitate a high permeation rate with respect to gaseous substances such as, for example, air even when the sealing rings are of comparatively high volume.

In one preferred embodiment a fluid-tight but gas-permeable gas exchange element is arranged on the support element to promote the gas permeability of the sealing arrangement.

For space reasons, it is preferable if such a gas exchange element is arranged in a central region of the support element, viewed in a radial direction, e.g. attached circumferentially in a fluid-tight manner at the edge of a central opening of the support element. Such an integration of a gas exchange element also allows a certain gas permeability or pressure compensating ability on the part of the sealing arrangement, thereby advantageously extending the durability or useful life of the piezoactuator.

As regards the material of the gas exchange element, hereafter referred to simply as the "gas exchange material", the primary consideration again is materials, as described above in relation to the sealing rings, i.e. in particular silicon materials, e.g. an FVMQ elastomer.

However another suitable gas exchange material is for example a microporous material, e.g. ePTFE (expanded polytetrafluoroethylene). This material has also proven very advantageous in that it can prevent "damaging media" such as fuel (diesel, petrol, etc) or lubricants (e.g. engine oil) penetrating the actuator chamber, while volatile substances can penetrate out of the actuator chamber and air or oxygen can penetrate into the actuator chamber. Other elastomer or microporous materials that can be used here are well known to the person skilled in the art and therefore require no further explanation.

For a compact structure of the sealing arrangement, it is advantageous if the gas exchange element is essentially disk-shaped, for example configured as a membrane. Such a gas exchange disk can for example extend over the entire cross-section of a through opening of the support element and be welded to the adjacent material at the circumference, e.g. by ultrasound welding, laser welding, etc. Alternatively the gas exchange disk can also be inserted into such a through opening through a press fit that seals it all round. To this end a clamping ring for example can be provided, which presses the gas exchange element axially against the edge of the opening, with the clamping ring in turn being secured to the support element by one of the securing variants mentioned above.

If the support element is combined with the external sealing ring and/or the internal sealing rings, as mentioned above, to form a pre-manufactured sealing unit, in one development the gas exchange element and an optionally provided clamping ring are already integrated on such a sealing unit, to simplify the assembly process further.

To use the gas exchange capacity of the sealing arrangement on the finished fuel injector as efficiently as possible to ventilate the actuator chamber, it is advantageous if a section of an injector housing arrangement, covering the contact module in a protective manner, has a ventilation arrangement, promoting an exchange of gas between the outside of the injector housing arrangement and the outside of the sealing arrangement described above. Such a ventilation arrangement can for example be provided by corresponding gas exchange apertures in the housing arrangement. Such a gas exchange aperture can for example be provided in particular for example in the form of a gap between a number of components, from which the injector housing arrangement is formed.

BRIEF DESCRIPTION OF THE DRAWINGS

The invention is described in more detail below based on exemplary embodiments with reference to the accompanying drawings, wherein.

DETAILED DESCRIPTION

Figure 1:
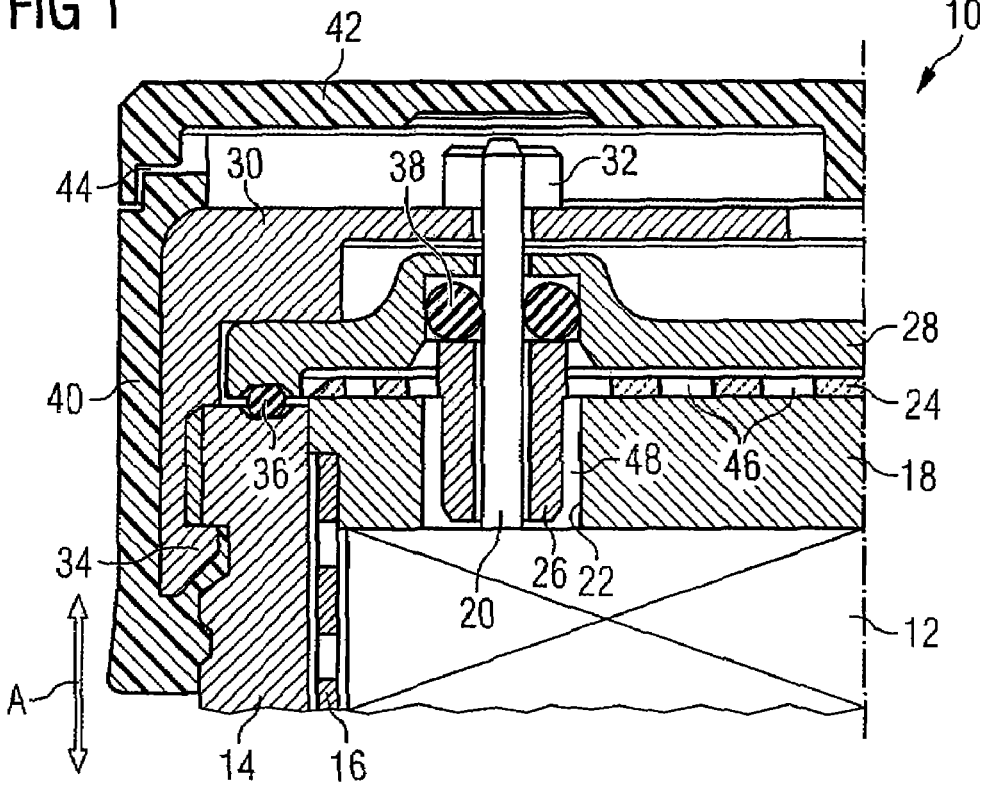
FIG. 1 shows an axial longitudinal section of a drive for a fuel injector in the region of the seal of a terminal post of the piezoactuator used.

FIG. 1 shows the configuration of a sealing arrangement 10 in a fuel injector according to a first embodiment. In a known manner the fuel injector comprises an injector housing arrangement extending in an axial direction A, housing a fuel injection valve and a piezodrive connected thereto via an active connection to activate the fuel injection valve. As far as the basic structure of the fuel injector is concerned, reference should only be made by way of example to known fuel injectors, as described for example in DE 199 56 256 B4 and 100 07 175 A1.

FIG. 1 shows part of the extended fuel injector in the region of its upper axial end. For the purposes of simplicity of the diagram, the section view in this figure only shows the left part, as in this sectional representation the right part is symmetrical to this.

The sealing arrangement 10 described in more detail below serves to seal a piezoactuator 12, which is housed in a known manner in a collar-shaped actuator housing 14, extending in the axial direction A, and is held by a Bourdon spring 16 under axial compressive pre-tension. The two axial ends of the Bourdon spring 16 are welded for this purpose to a metal top plate 18 and a base plate (not shown in FIG. 1), between which the piezoactuator 12 is held. The base plate is inserted such that it can be displaced in an axial direction A in the actuator housing 14 and when the piezoactuator 12 is activated electrically, it acts on a corresponding activation element of the fuel injection valve (not shown here). In contrast the top plate 18 at the upper end of the actuator housing 14 is connected securely to said upper end, for example being caulked or welded.

Electrical activation of the piezoactuator 12 is effected via two terminal posts projecting in an axial direction A from the piezoactuator 12, one of which can be seen in FIG. 1 and is marked with the reference character 20.

The top plate 18 positioned on the piezoactuator 12 is provided with openings 22 for the passage of the terminals posts 20 and, together with the upper end of the actuator housing 14, forms a top arrangement of the piezoactuator 12.

A disk 24 also provided with openings for the passage of the terminal posts 20 and made of an electrically insulating plastic material is positioned on the upper face of the top plate 18 and has collar extensions 26 formed on in a single piece for guiding purposes and for the electrical insulation of the terminal posts 20 from the top plate 18.

The sealing arrangement 10 serves to prevent penetration of damaging media such as fuel or engine oil into the actuator chamber.

The sealing arrangement 10 comprises a support element 28 made of a comparatively rigid plastic material using an injection method, which is also provided with openings for the passage of the terminal posts 20, is positioned on the terminal posts 20 and is pressed in an axial direction A by the pressure exerted by a contact module 30 in an axial direction A toward the top arrangement 14, 18. The contact module 30 serves in a known manner to connect the terminal posts 20 of the piezoactuator 12 further in an electrical manner to an external electrical terminal of the fuel injector, for example a plug-in connector that is formed on. To this end the contact module 30 has contact elements formed in a plastic body, the ends of which have both welding plates 32 for welding to the contact posts 20 and also contact tongues to provide contacts for the external electrical terminal. An outer circumference of the contact module 30 encloses the upper end of the actuator housing 14 and has a latching lug 34 running in a circumferential direction and pointing radially inward, to latch the contact module 30 to the actuator housing 14. In the assembled situation shown an external circumferential region of the contact module 30 thus exerts an axial pressure on the support element 28 below it.

The sealing arrangement 10 also comprises an external sealing ring 36, which is clamped along a circumferential region of the top arrangement 14, 18, namely on an end face of the actuator housing 14 between said end face and the support element 28, thereby providing a seal between the support element 28 and the top arrangement 14, 18. This seal is referred to hereafter as the "external seal".

The sealing arrangement 10 also comprises internal sealing rings 38, each enclosing one of the terminal posts 20 and each being clamped between a face of the support element 28 facing radially inward and a circumferential face of the terminal post 20, thus providing a seal between the support element 28 and the terminal posts 20. These seals provided at the terminal posts 20 are also referred to hereafter as "internal seals".

The internal sealing rings 38 are held in cup-shaped indentations of the otherwise essentially disk-shaped support element 28, said cup-shaped regions being dimensioned such that in the assembled state shown a radial pressure is exerted on the internal sealing rings 38.

The sealing rings 36, 38 are formed from an elastomer, e.g. of the FVMQ type. As elastomer materials can often tear easily when subjected to tensile loading, it is a major advantage of the sealing arrangement 10 shown that these sealing rings 36, 38 are not subject to tensile loading, only compressive loading. This prevents premature failure of the sealing effect due to tearing of the sealing material. The support element 28 is formed from an electrically insulating plastic that is resistant to the relevant media and can absorb radial forces in the region of the internal seals due to the cup-shaped configuration, to press the internal elastomer sealing rings 38 between the terminal posts 20 and the cup walls. The internal seal is therefore produced by compressive force, generated by the permanently elastic characteristics in the elastomer material. The same applies to the loading of the external sealing ring 36, wherein the compressive loading is however exerted by the adjacent faces axially above and below.

To define the position of the external sealing ring 36 clearly or to simplify assembly, the end face regions of both the support element 28 and the actuator housing 14 clamping the sealing ring 36 are each provided with an annular groove, wherein an upper or lower part of the sealing ring is accommodated, to hold it in position.

Finally FIG. 1 also shows an external injector housing sheath, comprising a plastic molding 40 and a plastic cover 42 positioned thereon. The plastic molding 40 secures the latching of the contact module 30 to the actuator housing 14 and forms a base for the cover positioned thereon, for example latched to the plastic molding 40 or welded on, which in turn forms an upper protective cover for the contact module 30, the welding plates 32 and the terminal posts 20. A number of labyrinthine gas exchange apertures are formed between the molding 40 and the cover 42, one of which can be seen in FIG. 1, marked with the reference character 44.

The labyrinthine configuration of the gas exchange apertures 44 configured as a gap between the molding 40 and the cover 42 prevents the penetration of solid objects into the interior of the covering 40, 42. The pattern of these apertures 44, as shown in the figure, also allows any fluid that has penetrated inside the covering 40, 42, e.g. engine oil, to flow out again of its own accord due to the force of gravity.

The elastomer material used in the exemplary embodiment shown for the sealing rings 36, 38 has a significant gas permeability, such that the sealing arrangement 10 advantageously inhibits or blocks the penetration of fluid media into the actuator chamber, while permitted a certain gas exchange. To use the gas exchange capability of the sealing arrangement 10 as efficiently as possible to ventilate the actuator chamber, the configuration of the external covering 40, 42 as described above with one or more gas exchange apertures 44 is very advantageous. These apertures 44 promote a gas exchange between the outside of the injector housing arrangement and the outside of the sealing arrangement 10. This creates a gas exchange between the actuator chamber and the installation environment of the fuel injector that is advantageous for the durability of the piezoactuator 12.

In order also to promote a gas exchange flow in the interior of the sealing arrangement 10, provision is made with the exemplary embodiment shown for the insulating disk 24 to have recesses 46 that promote the passage of gas and for the collar extensions 26 to be dimensioned such that a small annular gap 48 remains between them and an internal circumferential face of the through openings 22.

When assembling the fuel injector, a pre-manufactured piezoactuator module comprising the piezoactuator 12, the Bourdon spring 16, the top plate 18 and the base plate (not shown) is first welded in the collar-shaped actuator housing 14. The insulating disk 24 is then positioned from above onto the top plate 18. The internal sealing rings 38 are then threaded onto the upstanding terminal posts 20 of the piezoactuator 12 and the external sealing ring 36 is positioned in the annular groove on the actuator housing 14. The disk-shaped support element 28 is then positioned from above and the contact module 30 is then pressed down from above until its latching lug 34 snaps into a corresponding latching groove on the external circumference of the actuator housing 14. This presses the support element 28 down toward the top arrangement 14, 18. At the same time the sealing rings 36, 38 are loaded compressively, such that the internal and external seals are created. The external plastic molding 40 is then configured in a molding process and finally the cover 42 is positioned from above and secured to the molding 40.

In the description which follows of further exemplary embodiments the same reference characters are used for similar components, in each instance with a small letter to differentiate the embodiment. Only the differences compared with the previously described embodiment(s) are examined and reference is made specifically to the description of previous exemplary embodiments.

Figure 2:
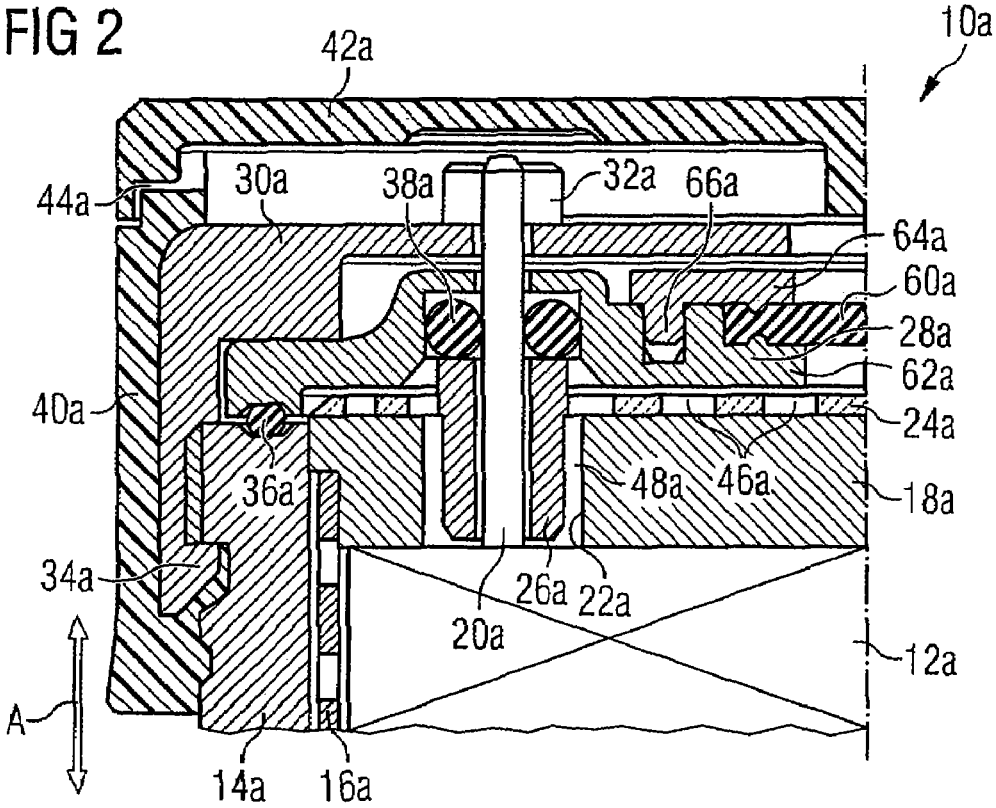
FIG. 2 shows the same view as in FIG. 1 of a sealing arrangement according to a further embodiment.

FIG. 2 shows a sealing arrangement 10*a*, wherein a gas-permeable gas exchange element 60*a* is arranged on a support element 28*a* to promote a gas exchange capability. The sealing arrangement 10*a* otherwise corresponds to the embodiment according to FIG. 1 in respect of structure and function. However due to the integration of the gas exchange element 60*a* it is however possible also to manufacture an external sealing ring 36*a* and/or internal sealing rings 38*a* from a material having a very low gas permeability, without significantly impairing the gas exchange.

The gas exchange element 60*a* used in the sealing arrangement 10*a* is a disc made of a fluoric silicon material (e.g. the FVMQ type), which is secured at its outer circumference in a sealing manner to the edge of a central opening in the support element 28*a*. Such securing is effected here in the form of an axial compression between an opening edge 62*a* of the support element 28*a* and a clamping ring 64*a*, which is in turn connected securely to the support element 28*a*. In the exemplary embodiment shown there is provision to this end for ultrasound welding of a projection 66*a* of the clamping ring 64*a*, running in a circumferential direction, in a corresponding annular groove of the support element 28*a*.

The support element 28*a*, together with the gas exchange disk 60*a* and the clamping ring 64*a*, forms a pre-manufactured module for fuel injector assembly.

Figure 3:
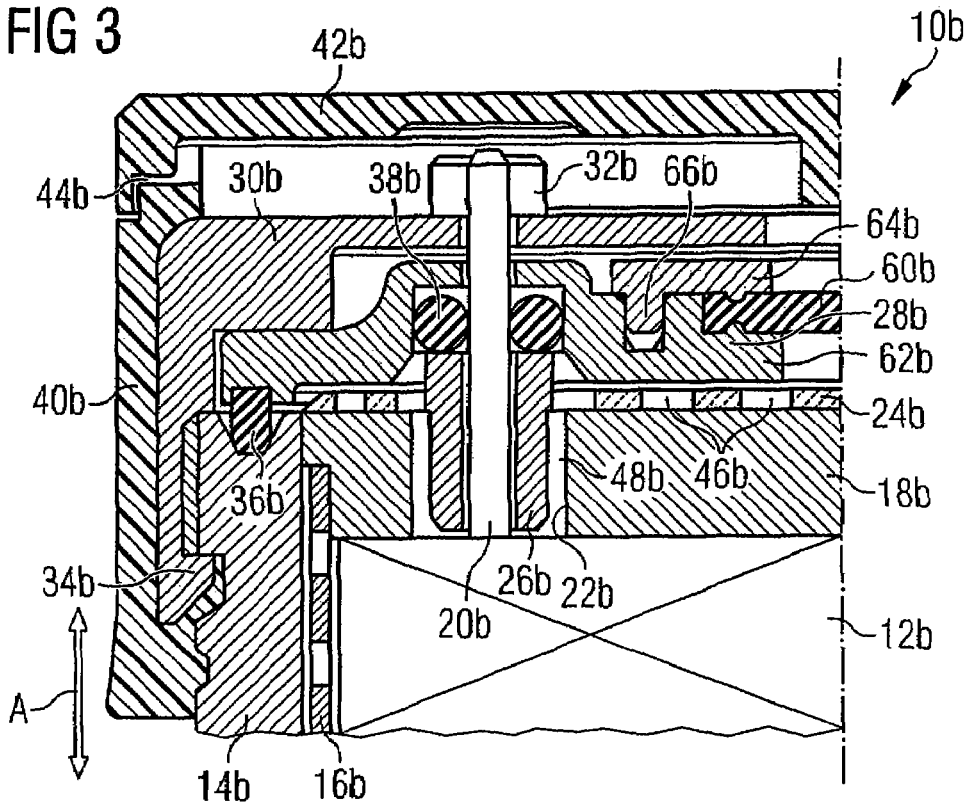
FIG. 3 shows the same view as in FIG. 1 of a sealing arrangement according to a further embodiment.

FIG. 3 shows a sealing arrangement 10*b*, wherein, unlike the embodiment described in relation to FIG. 2, a pre-manufactured sealing unit 28*b* comprising the support element 28*b* also has an external sealing ring 36*b*. This sealing ring 36*b* is manufactured using the two-component injection molding method together with the support element 28*b*. Alternatively the sealing ring 36*b* could for example be vulcanized onto the support element 28*b*.

Figure 4:
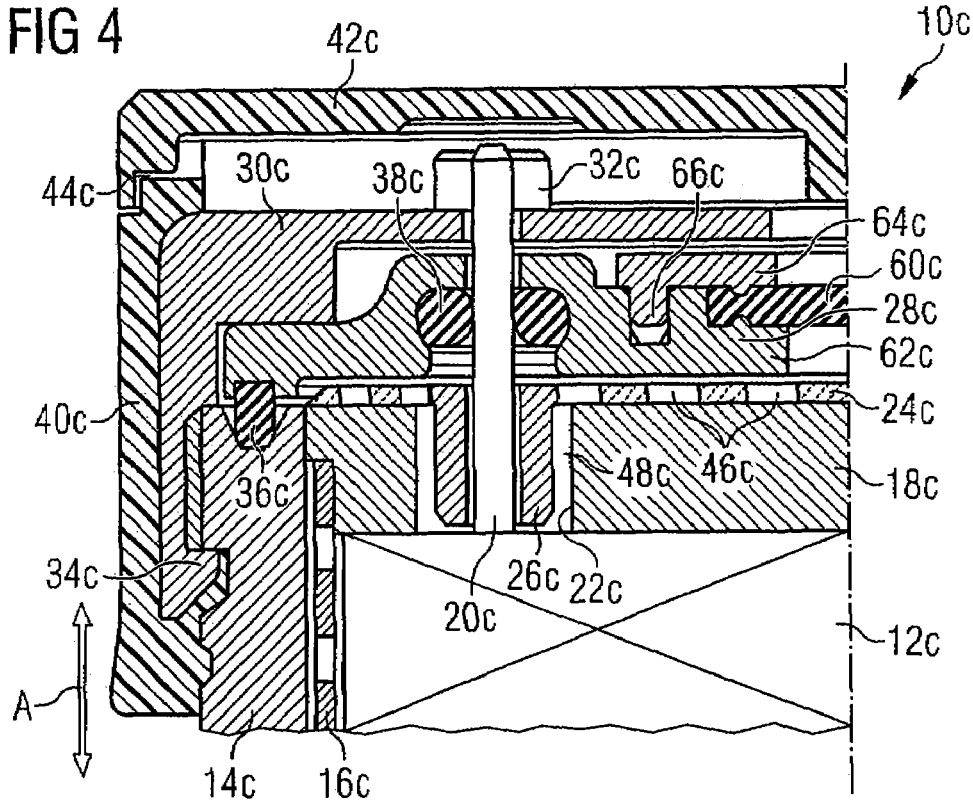
FIG. 4 shows the same view as in FIG. 1 of a sealing arrangement according to a further embodiment.

FIG. 4 shows a sealing arrangement 10*c*, wherein, unlike the embodiment described in relation to FIG. 3, internal sealing rings 38*c* are also integrated on the pre-manufactured sealing unit. In the exemplary embodiment shown, the sealing rings 38*c* are held in a positive manner in the cup-shaped regions by corresponding shaping of said cup-shaped regions. Alternatively the sealing rings 38*c* can be attached using a two-component method or by vulcanization.

Figure 5:
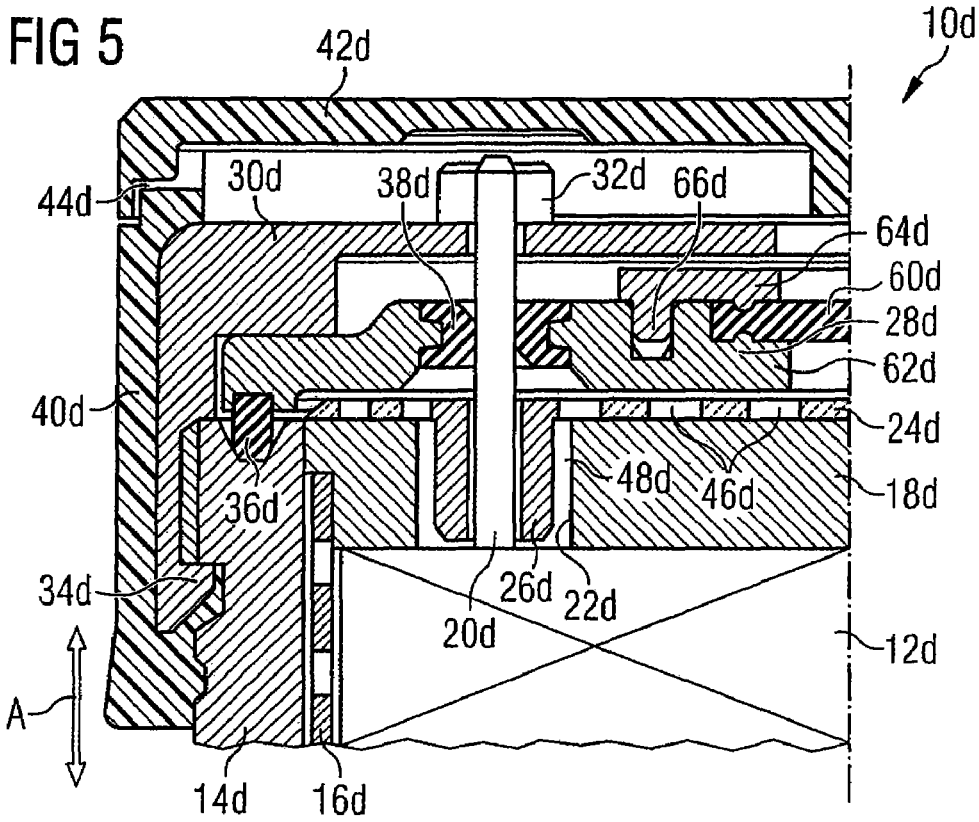
FIG. 5 shows the same view as in FIG. 1 of a sealing arrangement according to a further embodiment.

FIG. 5 shows a sealing arrangement 10*d*, wherein, unlike the embodiment described in relation to FIG. 4, a more compact configuration of the sealing unit is provided in the region of the internal seals. Internal sealing rings 38*d* are attached here at the edge of the openings of a support element 28*d* provided for the passage of terminal posts 20*d*. Such attachment can be produced by means of a positive connection and/or by producing a tight connection between the sealing material and the material of the support element 28*d*, perhaps using a two-component method or vulcanization.

Figure 6:
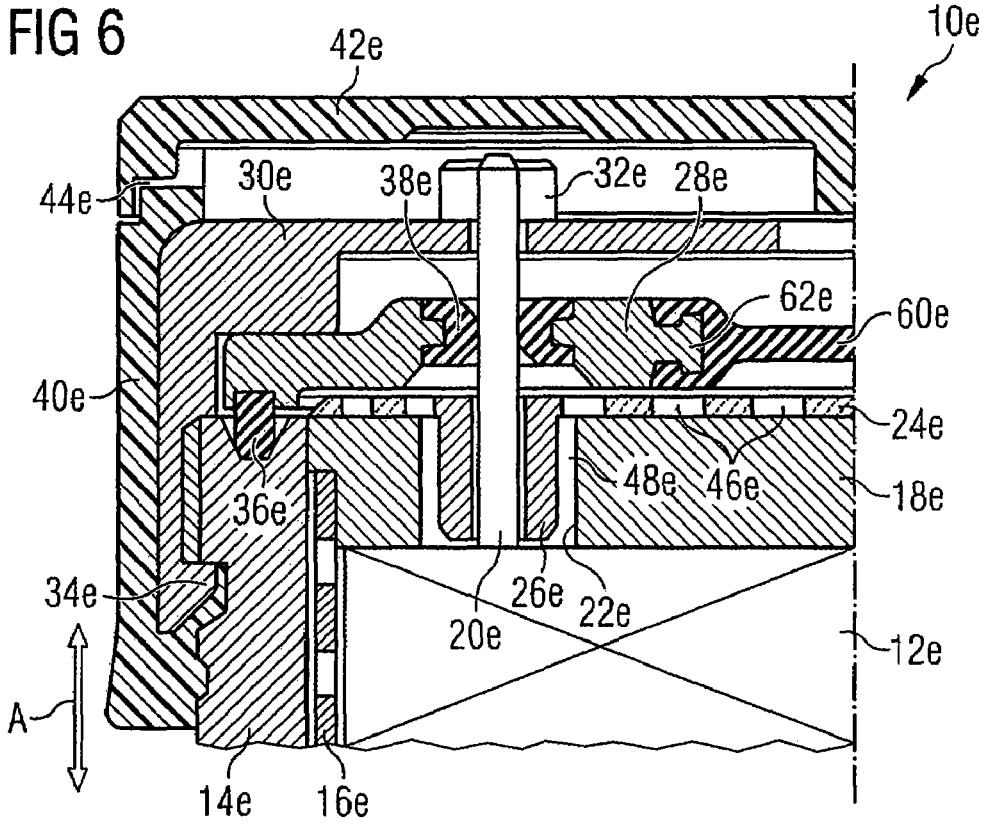
FIG. 6 shows the same view as in FIG. 1 of a sealing arrangement according to a further embodiment.

FIG. 6 shows a sealing arrangement 10*e*, wherein, unlike the embodiment described in relation to FIG. 5, a gas exchange element 60*e* is also integrated on the sealing unit comprising a support element 28*e* by means of a two-component method or vulcanization. This for example allows a more compact configuration of said "ventilation zone" of the sealing unit compared with the embodiments described in relation to FIGS. 2 to 5.

Figure 7:
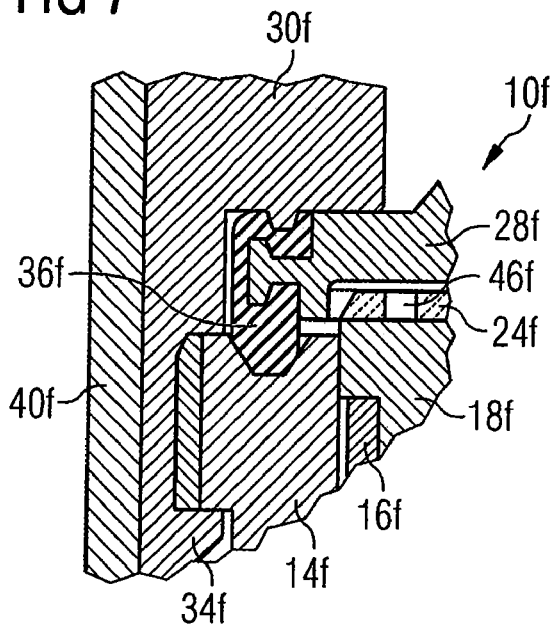
FIG. 7 shows the same view as in FIG. 1 of a sealing arrangement according to a further embodiment, only showing the region of the radially external seal.

FIG. 7 shows a sealing arrangement 10*f* (only in the radially extreme region), wherein, unlike the embodiments described in relation to FIGS. 1 to 6, an external sealing ring 36*f* is configured to enclose the external circumferential edge of a support element 28*f*. Depending on the specific geometric design, in this instance axial compressive forces can also be induced in the sealing ring material by means of a contact module 30*f*.

Figure 8:
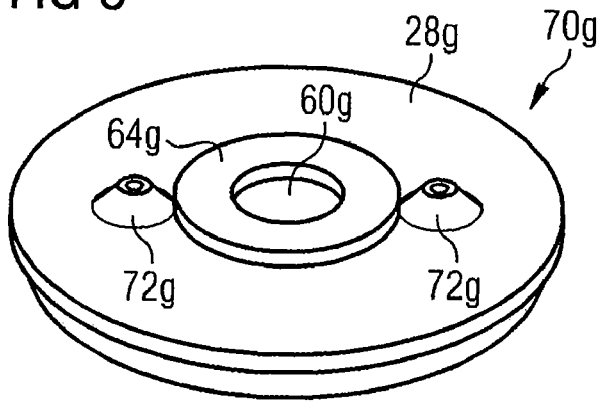
FIG. 8 shows a perspective view to illustrate the arrangement of a gas exchange element in a sealing unit.
Figure 9:
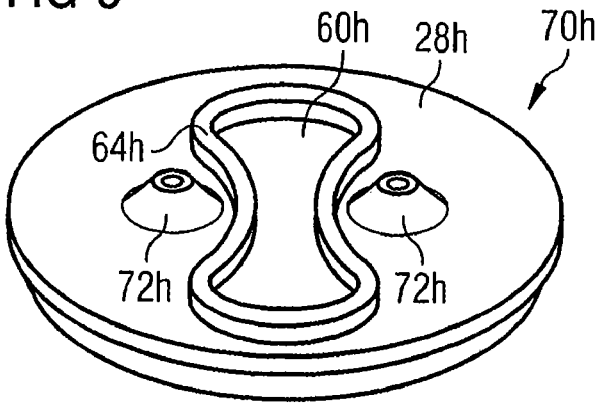
FIG. 9 shows the same view as in FIG. 8 of a sealing arrangement according to a further embodiment.

Two preferred possibilities for arranging or configuring the gas exchange element provided in the embodiments according to FIGS. 2 to 6 are shown schematically in FIGS. 8 and 9.

FIG. 8 shows a sealing unit 70*g* comprising a support element 28*g* with indentations 72*g* to create cup-shaped regions to produce the internal seals. The gas exchange element 60*g* here is configured in a circular manner and is secured by a circular clamping ring 64*g* on the support element 28*g*.

FIG. 9 shows an alternative embodiment of a gas exchange element 60*h* with a correspondingly tensioned embodiment of a clamping ring 64*h*. This variant advantageously offers a larger gas passage face for the gas exchange element 60*h*.

The following advantages in particular can result with the described embodiments of the sealing arrangement:

- Both the external seal and the internal seals ("terminal post seals") are achieved by compressing (applying pressure to) the sealing material. This prevents elongation of the sealing material, configured as an elastomer for example, which could lead to premature failure in the case of materials susceptible to tearing.
- The materials or material pairs for the external seal and the internal seals and for the optionally provided gas exchange element can be selected independently of each other and thus be optimized specifically to structural and/or functional requirements.
- For the external seal and the internal seals, it is possible advantageously to use sealing materials with a particularly high oxygen and nitrogen permeability, even if the material in question has a high level of susceptibility to tearing. As the material is only compressed, not elongated, to form the seals, susceptibility to tearing is not an issue.
- A number of and in particular essentially all components of the sealing arrangement can be combined to form a pre-assembled sealing unit, such that assembly of the fuel injector is significantly simplified.
- A corresponding structural configuration of the support element or a pre-manufactured sealing unit formed therefrom allows simple and secure assembly of the sealing arrangement. A positive connection from the support element toward the internal sealing rings in the assembly direction ensures particularly secure assembly.
- The sealing arrangement is particularly suitable for proven injector structures that are already in mass production or requires only slight structural changes to such injector structures.

What is claimed is:

1. A sealing arrangement to seal a piezoactuator in a fuel injector in an internal combustion engine comprising:

terminal posts projecting in an axial direction from the piezoactuator and a top arrangement positioned on the piezoactuator, provided with openings for the passage of the terminal posts, a support element, provided with openings for the passage of the terminal posts, positioned on the terminal posts and pressed in an axial direction toward the top arrangement, an external sealing ring, which is clamped along a circumferential region of the top arrangement between the support element and the top arrangement, and internal sealing rings, each enclosing one of the terminal posts and each being clamped between a face of the support element facing radially inward and a circumferential face of the terminal post.

2. A sealing arrangement according to claim 1, wherein the support element is formed of plastic.

3. A sealing arrangement according to claim 1, wherein the material of the support element is significantly more rigid than the material of the external sealing ring and the material of the internal sealing rings.

4. A sealing arrangement according to claim 1, wherein the support element is essentially disk-shaped, but having cup-shaped regions to receive the internal sealing rings.

5. A sealing arrangement according to claim 1, wherein the external sealing ring is clamped between end face regions of the support element extending essentially orthogonally and the top arrangement.

6. A sealing arrangement according to claim 1, wherein the support element is pressed by a contact module positioned thereon to connect the terminal posts further in an electrical manner to an external electrical terminal of the fuel injector.

7. A sealing arrangement according to claim 1, wherein the material of the external sealing ring and/or the internal sealing rings is an elastomer.

8. A sealing arrangement according to claim 1, wherein a disk made of electrically insulating material and provided with openings for the passage of the terminal posts is arranged on the face of the top arrangement facing the support element.

9. A sealing arrangement according to claim 1, wherein the support element, together with the external sealing ring and/or the internal sealing rings, is provided as a pre-manufactured sealing unit.

10. A sealing arrangement according to claim 1, wherein a fluid-tight but gas-permeable gas exchange element is arranged on the support element to promote the gas permeability of the sealing arrangement.

11. A sealing arrangement for a piezoactuator in a fuel injector in an internal combustion engine, comprising:

terminal posts projecting in an axial direction from the piezoactuator and a top arrangement positioned on the piezoactuator comprising openings for the passage of the terminal posts, a support element comprising openings for the passage of the terminal posts, positioned on the terminal posts and pressed in an axial direction toward the top arrangement, an external sealing ring clamped along a circumferential region of the top arrangement between the support element and the top arrangement, and internal sealing rings, each enclosing one of the terminal posts and each being clamped between a face of the support element facing radially inward and a circumferential face of the terminal post.

12. A sealing arrangement according to claim 11, wherein the support element is formed of plastic.

13. A sealing arrangement according to claim 11, wherein the material of the support element is significantly more rigid than the material of the external sealing ring and the material of the internal sealing rings.

14. A sealing arrangement according to claim 11, wherein the support element is essentially disk-shaped, but having cup-shaped regions to receive the internal sealing rings.

15. A sealing arrangement according to claim 11, wherein the external sealing ring is clamped between end face regions of the support element extending essentially orthogonally and the top arrangement.

16. A sealing arrangement according to claim 11, wherein the support element is pressed by a contact module positioned thereon to connect the terminal posts further in an electrical manner to an external electrical terminal of the fuel injector.

17. A sealing arrangement according to claim 11, wherein the material of the external sealing ring and/or the internal sealing rings is an elastomer.

18. A sealing arrangement according to claim 11, wherein a disk made of electrically insulating material and provided with openings for the passage of the terminal posts is arranged on the face of the top arrangement facing the support element.

19. A sealing arrangement according to claim 11, wherein the support element, together with the external sealing ring and/or the internal sealing rings, is provided as a pre-manufactured sealing unit.

20. A sealing arrangement according to claim 11, wherein a fluid-tight but gas-permeable gas exchange element is arranged on the support element to promote the gas permeability of the sealing arrangement.

* * * * *